United States Patent [19]

Morton

[11] 4,333,280

[45] * Jun. 8, 1982

[54] SHEAR LOAD RESISTANT STRUCTURE

[75] Inventor: Virgil R. Morton, Redondo Beach, Calif.

[73] Assignee: Verco Manufacturing, Inc., Phoenix, Ariz.

[ * ] Notice: The portion of the term of this patent subsequent to Feb. 5, 1997, has been disclaimed.

[21] Appl. No.: 209,874

[22] Filed: Nov. 24, 1980

Related U.S. Application Data

[60] Division of Ser. No. 86,271, Oct. 19, 1979, Pat. No. 4,335,557, which is a continuation-in-part of Ser. No. 936,176, Aug. 23, 1978, Pat. No. 4,186,535.

[51] Int. Cl.[3] ..... E04B 1/98

[52] U.S. Cl. ..... 52/167; 52/250; 52/336; 52/414

[58] Field of Search ..... 52/250, 336, 335, 814, 52/326, 406, 293, 732, 414, 167, 741, DIG. 15

[56] References Cited

U.S. PATENT DOCUMENTS

| | | | |
|---|---|---|---|
| 480,483 | 8/1892 | Worchester | 52/338 |
| 583,685 | 6/1897 | Jackson | 52/336 |
| 1,191,283 | 7/1916 | Cornwell | 52/336 |
| 1,240,634 | 9/1917 | Williams . | |
| 1,636,891 | 7/1927 | Barrows . | |
| 1,753,375 | 4/1930 | Heinen | 52/814 |
| 1,986,172 | 1/1935 | Wilson | 52/336 |
| 1,986,999 | 1/1935 | Burgess | 52/336 |
| 2,194,113 | 3/1940 | Covell . | |
| 2,485,165 | 10/1949 | Pollman . | |
| 2,804,953 | 9/1957 | Buehler . | |
| 2,916,110 | 12/1959 | Carran | 52/335 |
| 2,992,711 | 7/1961 | Mitchell | 52/801 |
| 3,461,629 | 8/1969 | Smith | 52/814 |
| 3,483,663 | 12/1969 | Gregoire . | |
| 3,656,270 | 4/1972 | Phillips | 52/693 |
| 3,720,029 | 3/1973 | Carran | 52/336 |
| 3,724,078 | 4/1973 | Carlin | 52/177 |
| 3,759,006 | 9/1973 | Tamboise | 52/406 |
| 3,820,295 | 6/1974 | Folley | 52/DIG. 15 |
| 3,956,864 | 3/1976 | Fang | 52/414 |
| 3,973,366 | 8/1976 | Balane | 52/221 |
| 3,995,403 | 12/1976 | Nickell | 52/284 |
| 4,099,359 | 7/1978 | Sivachenko | 52/797 |
| 4,186,535 | 2/1980 | Morton | 52/814 |

*Primary Examiner*—Price C. Faw, Jr.
*Assistant Examiner*—Henry E. Raduazo
*Attorney, Agent, or Firm*—Cahill, Sutton & Thomas

[57] ABSTRACT

The bottom flutes of a fluted deck or diaphragm of a building are fixedly attached to a horizontal load bearing member supported by vertical load resisting members. A load translation member precludes relative movement between the top flutes en masse and the bottom flutes en masse. By precluding relative movement of the top and bottom flutes, the shear loads imposed upon the diaphragm by earthquakes and/or high winds are translated through the load translation member and the load bearing member to the vertical load resisting members.

34 Claims, 9 Drawing Figures

SHEAR LOAD RESISTANT STRUCTURE

This is a division of application Ser. No. 86,271, filed Oct. 19, 1979 and now U.S. Pat. No. 4,335,557 which is a continuation-in-part from application Ser. No. 936,176 filed Aug. 23, 1978 and now U.S. Pat. No. 4,186,535.

The present invention relates to building structures and, more particularly, to diaphragms for resisting deformation due to horizontal shear loads.

In the field of building construction, diaphragms are elements in the horizontal plane disposed at the floor and roof levels which provide vertical support and resist horizontal shear loads. The types of horizontal shear loads of concern are shear loads primarily caused by earthquakes and/or high winds. Typically, variously configured metal decks or diaphragms have replaced earlier structural systems incorporating horizontal cross-bracing.

The shear resistance offered by diaphragms are dependent on a plurality of variables such as thickness of the deck, span of the deck and the type of connection intermediate the diaphragm supporting frame. Another factor to be considered is that of the stiffness of the diaphragm since a stiff diaphragm will reduce or limit the deflection of the building walls. Additionally, a stiff diaphragm will allow a larger sized diaphragm as its ultimate size is a function of the diaphragm deflection.

Recently, the International Conference of Building Officials, a body which has established the minimum earthquake and/or wind loads that buildings must be designed to resist, has increased the required earthquake induced load resistance capability by forty percent. Or, stated another way, in order for diaphragms to meet the increased standards published for use by architects and engineers, a diaphragm must be able to resist an additional forty percent load over previous requirements. To meet these higher standards, extensive investigations have been conducted to determine the points of failure resulting from shear loads. By destructive testing, it has been learned that presently used fluted decks, or variations thereof, tend to buckle and deform with little translation of the shear loads to horizontal shear load resisting members.

Various structures have been developed in an attempt to create diaphragms which can resist high shear loads and which are stiff. A representative type of such structure is described and illustrated in U.S. Pat. No. 3,759,006. Herein, an open bay network diaphragm is developed from a plurality of longitudinally oriented frame members, each having a closed trapezoidal cross-section. Segmented transversely oriented trapezoidal members extend intermediate adjacent longitudinally oriented frame members. Means are disposed about the periphery of the diaphragm to create a modular-like unit for attachment to a skeletal building framework. Each of the diaphragms is relatively stiff and able to absorb shear loads; however, each diaphragm is not rigidly attached to the supporting framework. Instead, each diaphragm rests upon insulating wedges. Accordingly, little if any translation of shear loads from the diaphragm to the skeletal framework occurs. The following United States Letters Patent illustrate other types of structures useable as decks or diaphragms for buildings, U.S. Pat. Nos.: 583,685; 2,194,113; 2,485,165; 2,804,953 3,483,663; 3,656,270; 3,973,366; 3,724,078; 3,956,864; and 3,995,403.

U.S. Pat. No. 2,992,711 is directed to structure for reinforcing the junction between a corrugated panel and a structural member in lightweight aircraft components. In essence, the structure contemplates the use of an external band of corrugated skin mating with the edge of the panel and a plurality of fingers of non-uniform length extend into the bottom opening corrugations, which fingers are physically locked in place with a bottom sheet extending along the bottom corrugations, the bottoms of the fingers and the bottom of the bar; a joggled member secures the top of the bar to the top of the skin. Spot welds are described as securing the elements to one another rather than ordinary surface welds. Since the structure is practical only for corrugations of ⅜" or less and material thicknesses of 0.002" to 0.016", it has no utility for building structures.

It is therefore a primary object of the present invention to provide a building structure capable of withstanding horizontal shear loads imposed by earthquakes and/or high winds.

Another object of the present invention is to provide a diaphragm for translating the horizontal shear loads imposed upon a building to vertical load resisting elements.

Yet another object of the present invention is to reduce the weight of a diaphragm by transferring any imposed shear loads to a supporting building framework.

Still another object of the present invention is to provide a means for precluding relative movement and buckling between flutes of a fluted diaphragm by translating the horizontal shear loads to a supporting framework.

A further object of the present invention is to provide a means for stiffening a diaphragm with the use of lighter gauge materials.

A yet further object of the present invention is to provide a building structure which is capable of withstanding high shear loads at a reduced net cost.

A still further object of the present invention is to provide a load translation member for maintaining stable with respect to one another the top and bottom flutes of a fluted diaphragm during imposition of a horizontal shear load thereupon.

These and other objects of the present invention will become apparent to those skilled in the art as the description thereof proceeds.

The present invention may be described with greater specificity and clarity with reference to the following drawings, in which.

Figure 1:
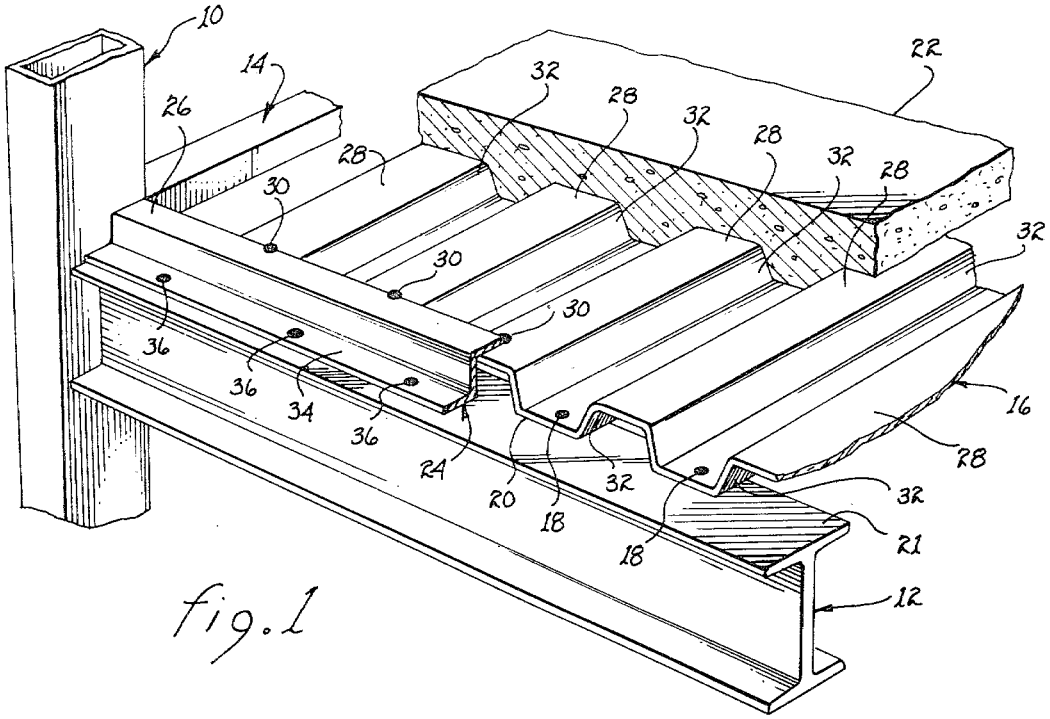
FIG. 1 is a perspective view of a diaphragm fixedly attached to a segment of a building framework.

Referring to FIG. 1, there is illustrated a segment of a building framework having a vertical load resisting member 10 supporting horizontal load bearing members 12 and 14. Horizontal load bearing member 12, which may be an I beam as depicted, supports one of the opposed open ends of a fluted deck or diaphragm 16. The diaphragm is attached to the horizontal load bearing member by means of puddle welds 18 welding bottom flutes 20 to horizontal flange 21 of the I beam. It may be noted that puddle welds 18 are disposed interior of the edge of each bottom flute 20. Thereby, the bottom flutes are maintained in fixed spacial relationship to one another by the I beam. Concrete 22, or the like, may be poured upon diaphragm 16 to form the floor or working surface of the diaphragm.

Figure 2:
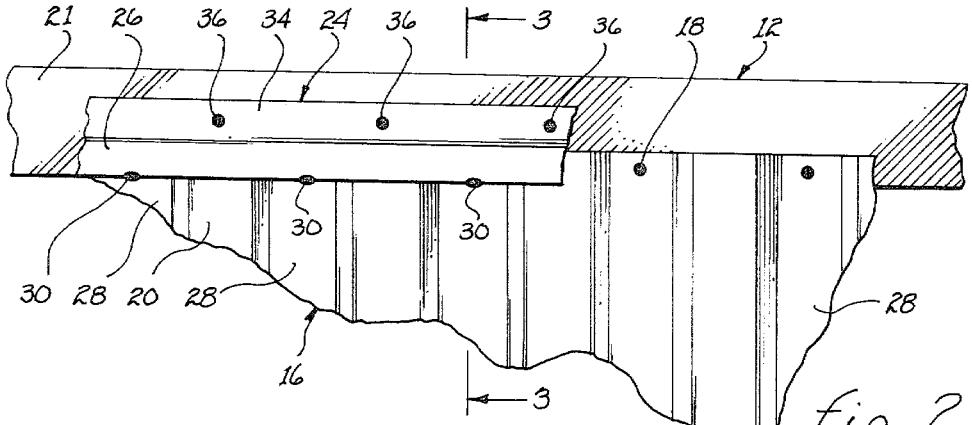
FIG. 2 is a partial cutaway top view of the interconnection intermediate a diaphragm and a building framework.
Figure 3:
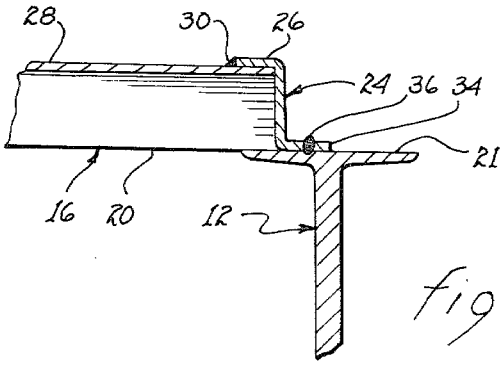
FIG. 3 is a cross-sectional view taken along lines 3—3 shown in FIG. 2.
Figure 4:
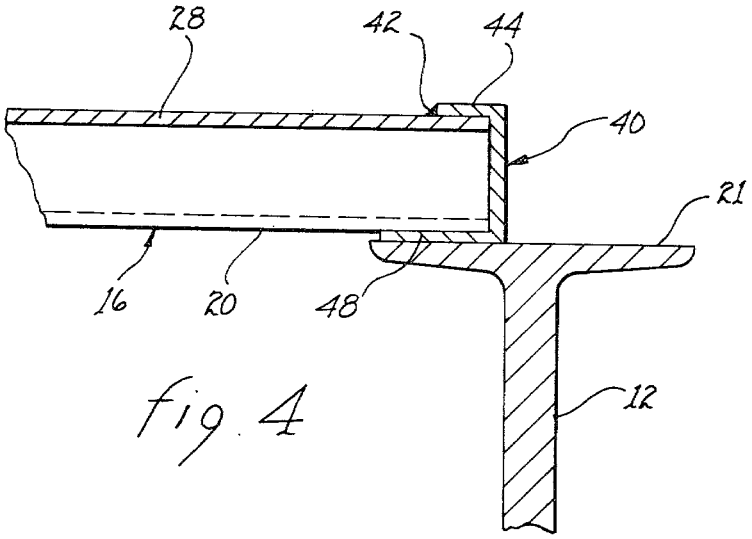
FIGS. 4 and 5 are cross-sectional views of a C channel interconnecting the end of a diaphragm with a load bearing member.
Figure 5:
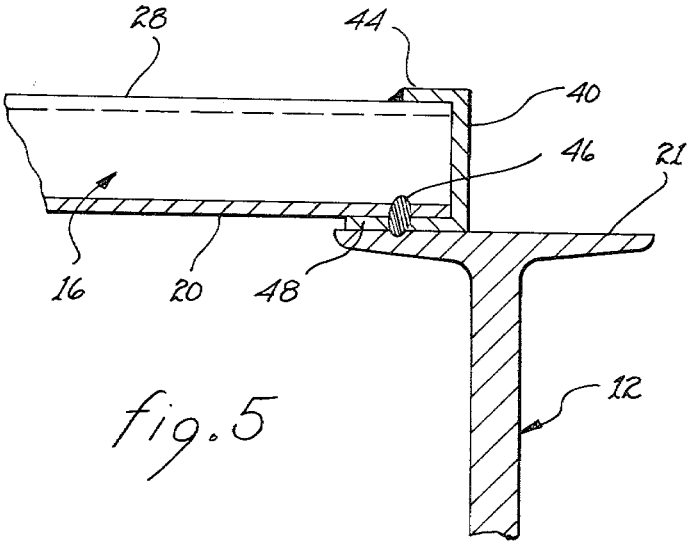

With joint reference to FIGS. 1, 2 and 3, the structure for translating horizontal shear loads imposed upon diaphragm 16 to vertical load resisting member 10 will be described. A load translation member 24, which may be Z-shaped in cross-section as depicted, a C-shaped channel as shown in FIGS. 4 and 5 or a profile plate as shown in FIGS. 6–9, is positioned adjacent each open end of diaphragm 16. Flange 26 of load translation member 24 is rigidly attached to top flutes 28 by welds 30. These welds bridge the longitudinal edge of flange 26 with the planar top surface of each top flute 28. Thereby, flange 26 of load translation member 24 maintains the top flutes in continuing spacial and fixed relationship to one another.

Movement of the top flutes en masse with respect to the bottom flutes en masse is now possible only through buckling, deformation or bending of webs 32 interconnecting the top and bottom flutes. Flange 34 of load translation member 24 is secured to flange 21 of horizontal load bearing member 12 through puddle welds 36 which puddle welds 36 are disposed interior of the longitudinal edge of flange 34 and engage the planar surface of flange 21 of the load translation member. Any forces attempting to move the top flutes en masse with respect to the bottom flutes will be primarily resisted by the load translation member and not by the webs of the diaphragm. Since the top flutes 28 are precluded from movement along the longitudinal axis of the horizontal load bearing member and as bottom flutes 20 are rigidly attached to flange 21 of the horizontal load bearing member, laterial displacement of the top flutes with respect to the bottom of the flutes is effectively precluded. Accordingly, buckling or other deformation of webs 32 will not and cannot occur until failure of load translation member 24 occurs.

In the event the load translation member is a C-shaped channel, the top flutes would be welded to the upper flange of the C-shaped channel, as described above. The lower flutes, however, would be welded by puddle welds to the lower flange of the C-shaped channel and to the supporting underlying load bearing member. The C-shaped channel, as a load translation member, would be used when two diaphragms are in abutting relationship or when the fluted end of the diaphragm must be positioned adjacent a vertical wall. More particularly, FIGS. 4 and 5 illustrate a C-shaped channel 40 interconnecting a diaphragm 16 with a horizontal load bearing member 12. Each top flute 28 of the diaphragm is welded by weld 42 to the edge of upper flange 44 of the C-shaped channel. Each bottom flute 20 is welded by a puddle weld 46 to both lower flange 48 of the C-shaped channel and to flange 21 of horizontal load bearing member 12. Thereby, the positional relationship of both the C-shaped channel with respect to the load bearing member and the bottom flute of the diaphragm with respect to the C-shaped channel are established. It may be noted that flange 44 is approximately half the width of flange 48 to provide access from above for making puddle welds 46.

Figure 6:
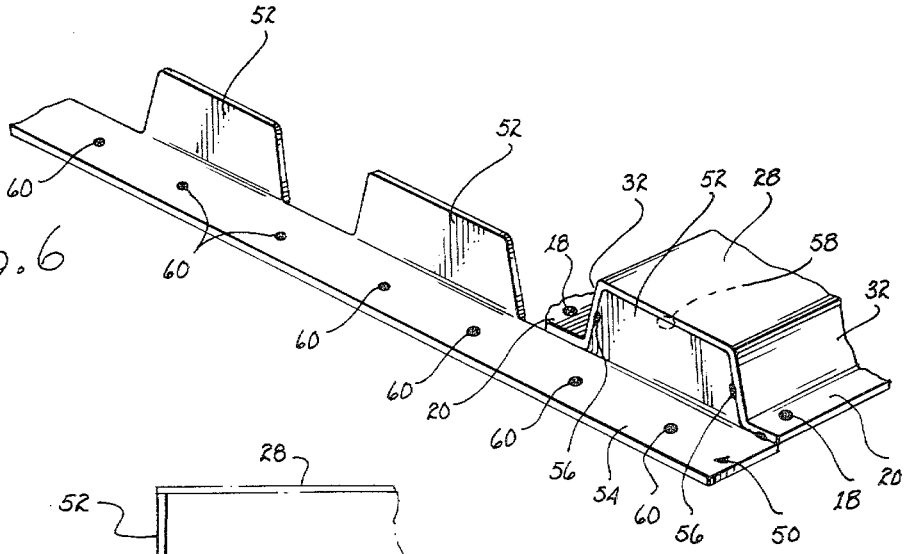
FIG. 6 illustrates a profile plate for stabilizing a fluted deck.
Figure 7:
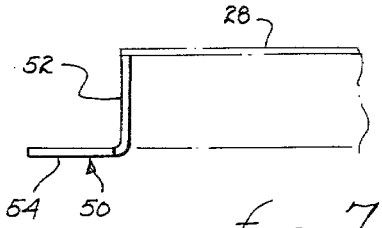
FIG. 7 illustrates a side view of the profile plate shown in FIG. 6.

FIGS. 6 and 7 illustrate a load translation member in the form of a profile plate member 50. The profile plate member includes a plurality of profile plates 52 bent upwardly at an angle, such as ninety degrees (90°) from a plate 54. The configuration of each profile plate is essentially duplicative of the cross-section defined by webs 32 and top flute 28 of diaphragm 16 to permit each profile plates to be placed within the confines of the respective webs and top flute perpendicular to the longitudinal axis of the flutes. Bottom flutes 20 are secured to an underlying support surface, such as flange 21 of load bearing member 12 shown in FIGS. 1 and 2, by puddle welds 18, as described above. Webs 32 are secured to the attendant profile plate by welds 56. Alternately, or in addition, welds 58 (shown in phantom lines) may be employed to secure top flutes 28 to the respective profile plates. It will therefore become apparent that each profile plate maintains each pair of webs and the interconnecting top flute in rigid relationship to one another. Any shear loads imposed upon diaphragm 16 are therefore translated through the profile plates rather than through the webs. Accordingly, failure of the diaphragm due to shear loads can only occur after failure of the profile plates or failure of the profile plate member.

The shear loads translated through the profile plates are translated into plate 54 from which they extend. This plate is secured to the underlying support surface (such as flange 21 of load bearing member 12) by puddle welds 60.

By inspection, it may be noted that bottom flutes 20 are rigidly secured to the underlying surface (flange 21) by welds 18 and that webs 32 and top flute 28 are secured to the same underlying surface through a load translation member configured as a profile plate member 50. Accordingly, the top and bottom flutes are immobile with respect to one another despite any imposed horizontal shear loads unless failure of the profile plate member occurs.

Figure 8:
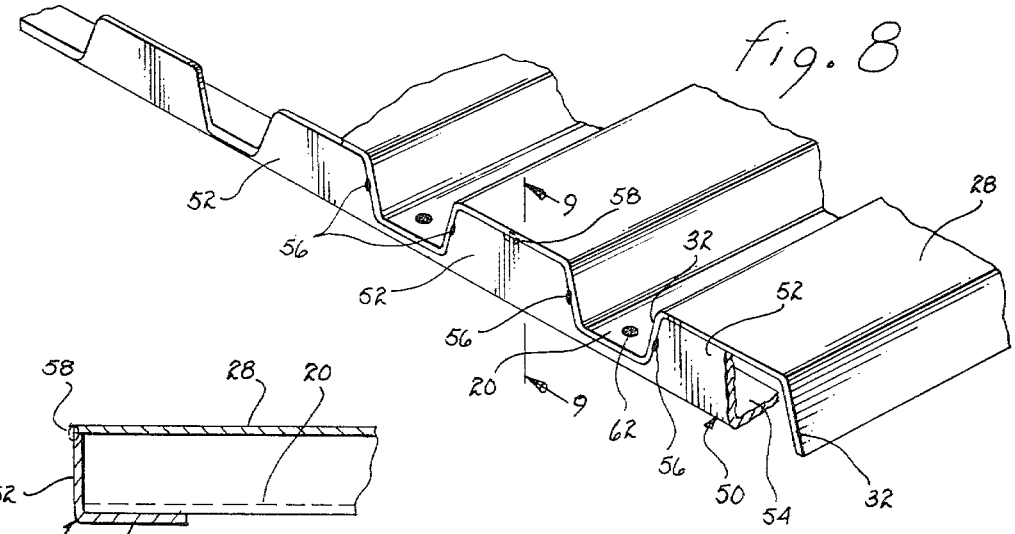
FIG. 8 illustrates a further profile plate for stabilizing a fluted deck.
Figure 9:
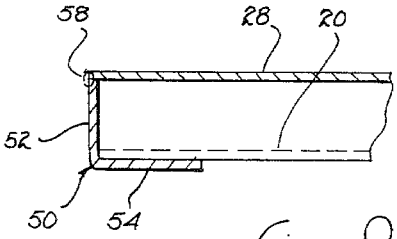
FIG. 9 illustrates a side view of the profile plate shown in FIG. 8.

FIGS. 7 and 8 illustrate an orientation of profile plate member 50 which may be used for abutting diaphragms or in placing a diaphragm adjacent a vertical wall. Herein, plate 54 extends beneath bottom flutes 32 and profile plates 52 extend within each pair of webs 32 and adjoining top flute 28. Each profile plate is secured to the webs by welds 56 alone and/or to top flute 28 by welds 58 (shown in plantom lines). The bottom flutes and plate 54 jointly are secured to the underlying supporting surface (such as flange 21 of load bearing member 12) by puddle welds 62.

By inspection, it becomes apparent that bottom flutes 20 are rigidly secured to the underlying supporting surface by puddle welds 62 and top flutes 28 are rigidly secured to the same underlying supporting surface through welds 56, profile plates 52, plate 54 and puddle welds 62. Thus, relative movement between the top and bottom flutes is inhibited by the profile plate member and is not dependent upon the rigidity of webs 32.

It is to be understood that regardless of which of the above described load translation members is employed, it is not mandatory that all top flutes individually be secured to it; nor is it mandatory that all bottom flutes individually be secured to the load bearing member.

Although the terms "weld", "puddle weld", etc., are used, it is to be understood that other attachment means, such as bolt and nut combinations, adhesives, etc., may be used to secure the various elements to one another.

Depending on the shear loads which might be imposed, the gauge of the diaphragm 16 may range between 24, 22, 20 or 18 gauge (nominal thickness being 0.0239", 0.0299", 0.0359" or 0.0478", respectively). The gauge of load translation member 24 is preferably of 16 gauge material (0.0598" thick) for two reasons. First, this thickness of material has sufficient mass to retain enough heat during welding to insure good welds between it and the diaphragm. Secondly, any failure due to excessive loads above predetermined calculated load bearing limits will occur in the diaphragm and not in the load translation member; thereby, the variables attendant shear load resistance are reduced and the specifications for a shear load resistant diaphragm building structure are more accurately determinable.

For most uses of the structure described herein, whether employed as a floor deck or a roof deck, sufficient strength and rigidity is obtained from 1½" fluted configuration; that is, the distance between the top surface of the upper flutes to the bottom surface of the lower flutes is 1½". For superior load capacities in long span configurations the thickness of the diaphragm may be increased to 3 inches.

When a building incorporating the present invention, is subjected to the tremors of an earthquake or high winds, horizontal shear loads will be imposed upon diaphragm 16. These shear loads, normally tending to displace top flutes 28 with respect to bottom flutes 20, will be translated through load translation member 24 to horizontal load bearing member 12. Consequently, displacement of the horizontal load bearing member along its longitudinal axis will tend to occur. Displacement of the horizontal load bearing member is effectively precluded by vertical load resisting member 10. As a result, the shear loads imposed will not be manifested in buckled or deformed diaphragms but will be resisted by the building framework members which are specifically configured to withstand expected horizontal shear loads imposed thereon.

Since the present invention tends to substantially increase resistance of a diaphragm to buckling or deformation, lighter gauge material for the diaphragm may be employed while maintaining an adequate safety factor. The permissible use of lighter gauge material reduces the material costs and fabrication techniques for the diaphragm. The additional cost of load translation member 24 and the labor costs of welds 30 and 36, 42 and 46, 56 (and 58) and 60, or 18 and 56 (and 58), depending upon the configuration of the load translation member, does tend to offset the savings effected by lighter gauge material but the additional costs are proportionally less the larger the span or surface area of the diaphragm. The net commercial benefit is that of providing a structure of superior horizontal shear load capability while reducing the cost below that of conventional presently used diaphragms. To illustrate the savings possible, the following is presented as exemplary. A typical 200' by 200' department store has 40,000 square feet of horizontal area. Such a building would require 400 lineal feet of load translation member 24 at a cost of approximately twenty extra dollars. The shear loads for such a building would be approximately 900 pounds per foot and would require 18 gauge material for a conventional diaphragm structure. By use of the present invention, 20 gauge material may be employed to develop the same shear load resistance. The difference in price between 18 gauge and 20 gauge material is approximately twelve cents per square foot. The net savings resulting from a conversion of only half of the building to utilize the present invention would amount to about four cents per square foot. Larger buildings would produce greater savings while smaller buildings would show somewhat lesser savings. Nevertheless, in the highly competitive construction field, a savings of this magnitude is significant.

Aside from the benefits of greater shear load resistance for a given thickness of material for the diaphragm, the present invention also produces a stiffer diaphragm for any given material thickness. The added stiffness produces or promotes further savings possible through the use of larger diaphragms, reduction in the expected deflection of the vertical walls and a reduction in the number of shear walls required.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A diaphragm for translating horizontal shear loads imposed thereon through a supporting load bearing member to vertical load resisting members in buildings, said diaphragm comprising in combination:

(a) a fluted deck, said fluted deck including webs alternately interconnecting top and bottom flutes terminating at opposed open ends defined by the extremities of said webs, said top flutes and said bottom flutes, said fluted deck having each of the opposed open ends supported by a load bearing member;

(b) first attachment means for rigidly securing selected ones of said bottom flutes to the supporting load bearing member;

(c) load translation means transversely located with respect to the flutes of said fluted deck for interconnecting selected ones of the open ends defined by said top flutes and adjacent ones of said webs with the load bearing member;

(d) second attachment means for rigidly securing at least one of said webs and the interconnecting one of said top flutes of the selected ones of the open ends directly to said load translation means; and (e) third attachment means for rigidly securing said load translation means with the load bearing member;

whereby, said load translation means inhibits relative movement between said top and bottom flutes and buckling said webs of said fluted deck due to horizontal shear loads imposed upon said diaphragm and said load translation means translates the horizontal shear loads from said diaphragm to the load bearing member and ultimately to the vertical load resisting members.

2. The diaphragm as set forth in claim 1 wherein said load translation means comprises a profile plate member, said profile plate member including a plate and a plurality of profile plates extending from said plate, each of said profile plates being positionable in mating relationship with a pair of said webs and an interconnecting one of said top flutes.

3. The diaphragm as set forth in claim 2 wherein said second attachment means secures each of said profile plates with at least said mating top flute.

4. The diaphragm as set forth in claim 2 wherein said second attachment means secures each of said profile plates to at least a web of said mating webs.

5. The diaphragm as set forth in claim 4 wherein said second attachment means secures each of said profile plates to said mating top flute.

6. The diaphragm as set forth in claim 4 wherein said second attachment means comprises a weld.

7. The diaphragm as set forth in claim 4 wherein said plate extends adjacent said bottom flutes.

8. The diaphragm as set forth in claim 7 wherein said first and third attachment means are one and the same.

9. The diaphragm as set forth in claim 8 wherein said first and third attachment means comprises a puddle weld.

10. The diaphragm as set forth in claim 2 wherein said plate extends adjacent said bottom flutes.

11. A building for resisting horizontal shear loads imposed by earthquakes, high winds and the like, said building comprising in combination:

(a) vertical load resisting members for absorbing horizontal shear loads imposed upon the building;

(b) horizontal load bearing members attached to said vertical load resisting members for translating horizontal shear loads to said vertical load resisting members;

(c) a diaphragm supported by said horizontal load bearing members, said diaphragm comprising in combination:

i. a fluted deck, said fluted deck including webs alternately interconnecting top and bottom flutes and defining a total thickness of said diaphragm of at least $1\frac{1}{2}$ inches;

ii. first attachment means for rigidly securing selected ones of said bottom flutes to at least one of said horizontal load bearing members;

iii. load translation means for interconnecting selected ones of said top flutes with one another and with said one horizontal load bearing member;

iv. second attachment means for rigidly securing at least one of the webs and top flutes of selected pairs of said webs interconnected by one of said top flutes with said load translation means; and (d) third attachment means for rigidly securing said load translation means with said horizontal load bearing member;

whereby, said load translation member inhibits relative movement between said top and bottom flutes and buckling of said webs of said fluted deck due to shear loads imposed upon said diaphragm and said load translation member translates the shear loads imposed upon said diaphragm through said horizontal load bearing members to said vertical load resisting members.

12. The building as set forth in claim 11 wherein said load translation means comprises a profile plate member, said profile plate member including a plate and a plurality of profile plates extending from said plate, each of said profile plates being positionable in mating relationship with a pair of said webs and an interconnecting one of said top flutes.

13. The building as set forth in claim 12 wherein said second attachment means secures each of said profile plates with at least said mating top flute.

14. The building as set forth in claim 12 wherein said second attachment means secures each of said profile plates to at least a web of said mating webs.

15. The building as set forth in claim 14 wherein said second attachment means secures each of said profile plates to said mating top flute.

16. The building as set forth in claim 14 wherein said second attachment means comprises a weld.

17. The building as set forth in claim 14 wherein said plate extends adjacent said bottom flutes.

18. The building as set forth in claim 17 wherein said first and third attachment means are one and the same.

19. The building as set forth in claim 18 wherein said first and third attachment means comprises a puddle weld.

20. The building as set forth in claim 12 wherein said plate extends adjacent said bottom flutes.

21. A diaphragm for translating horizontal shear loads imposed thereon through a supporting load bearing member to vertical load resisting members in buildings, said diaphragm comprising in combination:

(a) a fluted deck, said fluted deck including webs alternately interconnecting top and bottom flutes terminating at opposed open ends defined by the extremities of said webs, said top flutes and said bottom flutes, said fluted deck having the opposed open ends supported by a load bearing member;

(b) first attachment means for rigidly securing selected ones of said bottom flutes to the supporting load bearing member;

(c) load translation means transversely located with respect to the flutes for structurally interconnecting selected ones of said top flutes of said deck with one another and with the load bearing member;

(d) second attachment means for rigidly securing selected ones of said top flutes directly to said load translation means; and (e) third attachment means for rigidly securing said load translation means with the load bearing member;

whereby, said load translation means inhibits relative movement between said top and bottom flutes and buckling of said webs of said fluted deck due to horizontal shear loads imposed upon said diaphragm and said load translation means translates the horizontal shear loads from said diaphragm to the load bearing member and ultimately to the vertical load resisting members.

22. The diaphragm as set forth in claim 21 wherein said load translation means comprises a Z-shaped member having a first flange attached by said second attachment means to the selected ones of said top flutes and a second flange attached by said third attachment means to the load bearing member.

23. The diaphragm as set forth in claim 22 wherein said first and third attachment means are puddle welds and said second attachment means is a fillet weld.

24. The diaphragm as set forth in claim 21 wherein said load translation means comprises a C-shaped channel having an upper flange attached to selected ones of said top flutes and a lower flange attached to selected ones of said bottom flutes.

25. The diaphragm as set forth in claim 24 wherein said first and third attachment means comprise the same attachment means.

26. The diaphragm as set forth in claim 25 wherein said second attachment means comprises a fillet weld and said first and third attachment means comprises a puddle weld.

27. The diaphragm as set forth in claim 24 wherein said upper flange of said C-shaped channel is substantially less wide than said lower flange.

28. A building for resisting horizontal shear loads imposed by earthquakes, high winds and the like, said building comprising in combination:

(a) vertical load resisting members for absorbing horizontal shear loads imposed upon the buildings;

(b) horizontal load bearing members attached to said vertical load resisting members for translating horizontal shear loads to said vertical load resisting members;

(c) a diaphragm supported by said horizontal load bearing members, said diaphragm comprising in combination:

i. a fluted deck, said fluted deck including webs alternately interconnecting top and bottom flutes and defining a total thickness of said diaphragm of at least 1½ inches;

ii. first attachment means for rigidly securing selected ones of said bottom flutes to at least one of said horizontal load bearing members;

iii. load translation means for structurally interconnecting selected ones of said top flutes with one another and with said one horizontal load bearing member;

iv. second attachment means for rigidly securing the selected ones of said top flutes with said load translation means; and (d) third attachment means for rigidly securing said load translation means with said one horizontal load bearing member;

whereby, said load translation member inhibits relative movement between said top and bottom flutes and buckling of said webs of said fluted deck due to shear loads imposed upon said diaphragm and said load translation member translates the shear loads imposed upon said diaphragm through said horizontal load bearing members to said vertical load resisting members.

29. The building as set forth in claim 28 wherein said load translation means comprises a Z-shaped member having a first flange attached by said second attachment means to the selected ones of said top flutes and a second flange attached by said third attachment means to said one horizontal load bearing member.

30. The building as set forth in claim 29 wherein said first and third attachment means comprise puddle welds and said second attachment means comprises a fillet weld.

31. The building as set forth in claim 28 wherein said load translation means comprises a C-shaped channel having an upper flange attached to selected ones of said top flutes and a lower flange attached to selected ones of said bottom flutes.

32. The building as set forth in claim 31 wherein said first and third attachment means comprise the same attachment means.

33. The building as set forth in claim 32 wherein said second attachment means comprises a fillet weld and said first and third attachment means comprise a puddle weld.

34. The building as set forth in claim 33 wherein said upper flange of said C-shaped channel is substantially less wide than said lower flange.

* * * * *